US005445270A

United States Patent [19]

Dratz

[11] Patent Number: 5,445,270

[45] Date of Patent: Aug. 29, 1995

[54] PACKAGING UNIT FOR PIPETTE TIPS

[75] Inventor: Werner Dratz, Karlsruhe, Germany

[73] Assignee: Carl Roth GmbH Co., Karlsruhe, Germany

[21] Appl. No.: 271,677

[22] Filed: Jul. 7, 1994

[30] Foreign Application Priority Data

Jul. 9, 1993 [DE] Germany ..... 9310258 U

[51] Int. Cl.[6] ..... B65D 73/00; B65D 85/20; B01L 9/00

[52] U.S. Cl. ..... 206/443; 206/460; 422/104

[58] Field of Search ..... 422/104; 206/443, 460, 206/363, 364, 438, 366

[56] References Cited

U.S. PATENT DOCUMENTS

| | | | |
|---|---|---|---|
| 3,047,144 | 7/1962 | Wissel | 206/460 X |
| 4,015,708 | 4/1977 | Kelm | 206/460 X |
| 5,011,779 | 4/1991 | Maimon | 422/104 X |
| 5,025,923 | 6/1991 | Okui | 206/460 X |
| 5,299,687 | 4/1994 | Hanifl et al. | 206/460 X |
| 5,350,059 | 9/1994 | Chester et al. | 206/460 X |

FOREIGN PATENT DOCUMENTS

| | | |
|---|---|---|
| 8010525 | 10/1981 | Germany . |
| 3711256 | 3/1991 | Germany . |
| 9106583 | 9/1991 | Germany . |
| 9203388 | 7/1992 | Germany . |
| 1415068 | 11/1975 | United Kingdom . |
| 2141396 | 12/1984 | United Kingdom . |

*Primary Examiner*—Bryon P. Gehman
*Assistant Examiner*—BethAnne C. Cicconi
*Attorney, Agent, or Firm*—Spencer, Frank & Schneider

[57] ABSTRACT

A packaging unit for pipette tips that have at their back ends a push-on sleeve having an annular edge. A planar, plate-shaped, thin carrier that is rectangular in plan view has on its top side a layer of a pressure adhesive. The pipette tips are detachably glued on the carrier by their annular edges in equidistant rows and columns.

4 Claims, 1 Drawing Sheet

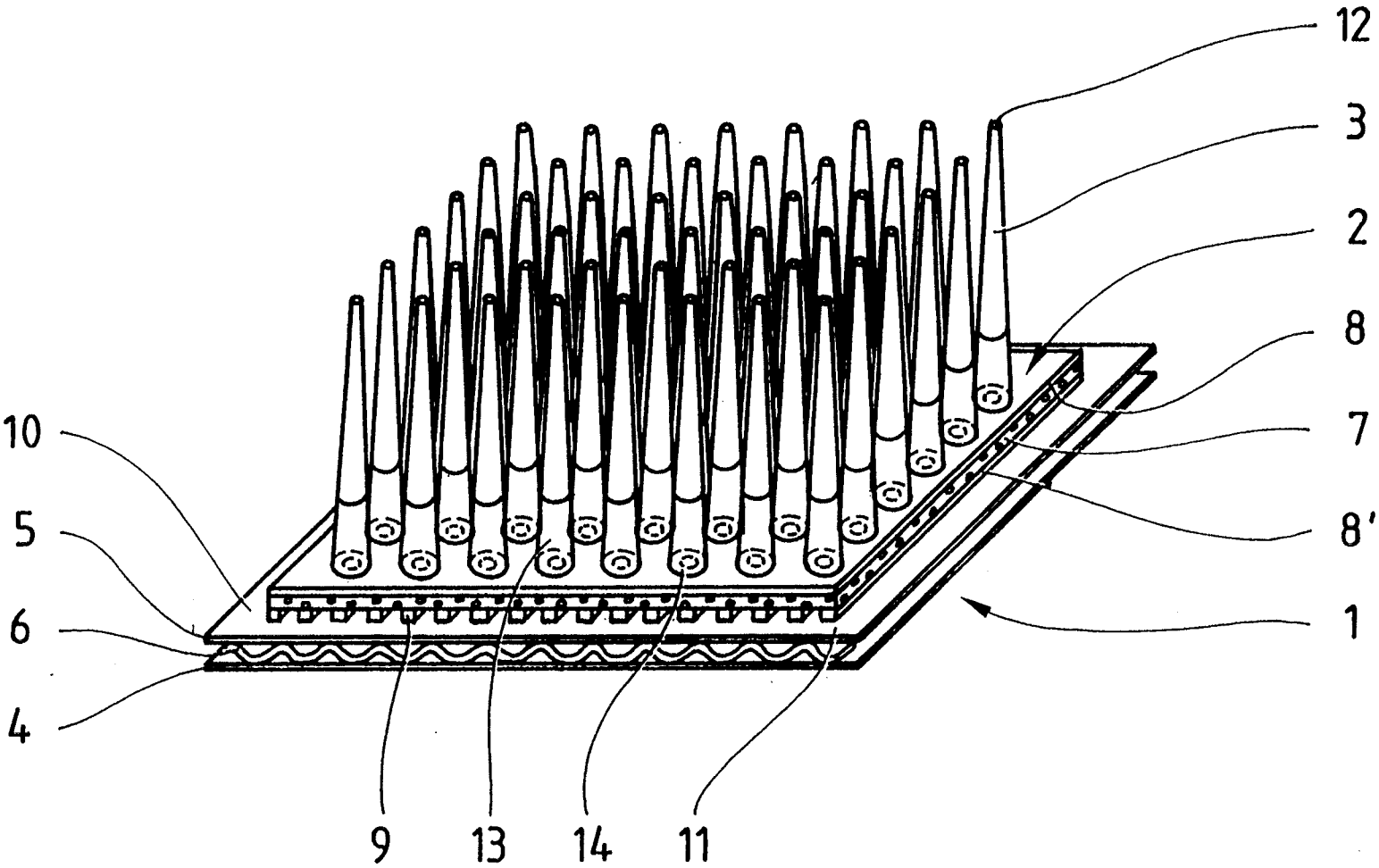
12
3
2
8
7
8'
1
11
14
13
9
10
5
6
4

PACKAGING UNIT FOR PIPETTE TIPS

CROSS REFERENCE TO RELATED APPLICATION

This application claims the priority of German Application No. G 93 10 258.5 filed Jul. 9, 1993, which is incorporated herein by reference.

BACKGROUND OF THE INVENTION

In modern laboratories of the chemical and pharmaceutical industries, as well as in public research facilities for medicine and molecular biology, to meet stringent sanitary standards, sterile, disposable goods are frequently used, for example sleeved aprons, gloves, protective hoods, filters, bulbs, pipette tips, syringes, weighing dishes, etc. Especially in the use of pipette tips for pipetting the smallest liquid quantities, the change has been made to one-time use, because only then can it be ensured that the pipette tips have properties such as a sealed seating of the push-on sleeve on the pipette, a clean and precisely-centered tip opening, acceptable surface quality, and optimum material transparency; these features permit precise and thus reproducible dimensioning of liquid samples.

Because up to twelve liquid samples are taken simultaneously in one pipetting procedure, a large quantity of pipette tips that can be used one time are required to meet the lab requirement. For economical pipetting, therefore, infusible pipette stands that can be autoclaved and that have pipette tips disposed in equidistant rows and columns are prepared so that the pipette tips can be removed easily from the pipetting implement. These pipette stands can, if needed, be sterilized with the pipette tips.

Frequently, the pipette tip stands are still provided manually with unsterile pipette tips, which are supplied in bags containing a thousand pieces; this is a painstaking and time-consuming task.

To avoid this manual labor, pipette tips are offered already disposed in equidistant rows and columns in cardboard or plastic containers. These containers have a plurality of recesses or holes that match the dimensions of the pipette tips, into which the pipette tips are sorted.

The containers with pipette tips can already be sterilized, provided that the nature of the container permits this. This is only the case for expensively produced, environmentally damaging plastic containers. However, this is not the case for less expensive, and therefore economical, cardboard containers. The pipette tips provided therein must be transferred into the infusible pipette tip stands which can be autoclaved and are provided for them for sterilization.

An adapter plate equipped with a plurality of upwardly-oriented receiving pins, which correspond to the push-on sleeves of the pipette tips and are disposed with standardized row and column spacing, can be used to transfer the pipette tips disposed in the container. In this instance, the receiving pins of the adapter plate, which is turned down, are inserted from above into the push-on sleeves of the pipette tips. Following this, the container is turned with the pipette tips and the adapter plate and is removed with the pipette tips from the adapter plate. Then the pipette tip stand is placed, with its top side turned down, with the pipette tips onto the adapter plate. Finally, the adapter plate is turned again, with the pipette tips and the pipette tip stand, and is removed with the pipette tips from the pipette tip stand.

In this complicated transfer procedure, both know-how and great care are required to obtain the desired result without individual pipette tips standing obliquely and hindering the procedure. Moreover, this type of procedure has an adverse effect on the required cleanliness of the pipette tips prior to sterilization.

SUMMARY OF THE INVENTION

It is an object of the present invention to provide an improved packaging unit for pipette tips that permits simple and rapid handling when the stands are provided with pipette tips.

This object is attained in a packaging unit for pipette tips that has at its back ends a push-on sleeve having an annular edge, by a planar, plate-shaped, thin carrier that is rectangular in plan view and has a pressure adhesive layer on its top side, with the pipette tips being detachably glued by their annular edges on the carrier in equidistant rows and columns. This configuration makes it possible to dispose the pipette tips with the standardized row and column spacing and connect them to one another by way of the carrier or layer; the carrier and the layer can simultaneously be used as transport means into the pipette tip stand. In doing so, the handling of the packaging unit of the invention is conceivably simple and time-saving; moreover, this solution is very cost-effective in production. In addition, depending on the dimensions of the carrier, different numbers of pipette tips can be glued on in different grids. The carrier can remain, with the layer, as a protective covering on the push-on sleeves of the pipette tips, which are open in the shape of a funnel, until shortly before use of the pipette tips for pipetting.

The layer advisably has a thin sheet that has a top film and a lower film of the pressure adhesive. The carrier can thus be pulled off from the lower film, and the sheet can be rolled, together with the upper film and the lower film, from the annular edges of the pipette tips, while the pipette tips are held securely in the pipette tip stand by means of a gentle tipping movement caused by the rolling.

The lower film of the pressure adhesive can be formed from a plurality of spaced, parallel, narrow strips. In this way the adhesive surface of the lower film is significantly reduced, so that the carrier can be very easily pulled from the lower film of the pressure adhesive adhering to the thin sheet.

On its top side, the carrier advantageously has a narrow, circumferential edge zone that is not covered by the layer of pressure adhesive. This feature facilitates handling of the packaging unit, because when the carrier is picked up manually, the adhesive layer surrounded by the circumferential edge zone is not touched.

In a particularly advantageous embodiment, the carrier is made of corrugated paper. Notably, three-layer corrugated paper comprising a lower, top and intermediate layer is particularly well-suited for this, because it is flexible parallel to the direction of corrugation of the intermediate layer, and extremely stiff perpendicular to the direction of corrugation of the intermediate layer. The carrier may be stripped off in a simple manner by the use of the cost-effective and environmentally friendly material.

The carrier can have a thickness of approximately one millimeter. Because of this feature, the plate-shaped carrier can also remain in a pipette tip stand that should be closed by an additional sliding cover without being an impairment when the sliding cover closes. Furthermore, up to this thickness of the carrier, it is still relatively simple to pull off the carrier or the carrier with the layer, respectively, from the pipette tips.

BRIEF DESCRIPTION OF THE DRAWING

The single FIGURE is a schematic representation in perspective of a packaging unit for pipette tips in accordance with the invention.

DETAILED DESCRIPTION OF THE PREFERRED EMBODIMENT

The illustrated packaging unit comprises a carrier 1, a layer 2 of a pressure adhesive and a plurality of pipette tips 3.

The planar, plate-shaped carrier 1 is rectangular in plan view and has a thickness of only one millimeter. Carrier 1 comprises a three-layer corrugated paper having a planar lower layer 4, a planar top layer 5 disposed parallel thereto, and a corrugated intermediate layer 6 disposed between these.

The layer 2 comprising a thin sheet 7 that has an upper film 8 and a lower film 8' of a pressure adhesive is releasably attached to carrier 1. Lower film 8' is composed of a plurality of narrow, parallel strips 9 spaced closely together. Strips 9 are oriented perpendicular to the direction of corrugation of intermediate layer 6 of carrier 1. Layer 2 completely covers the top side 10 of carrier 1 up to a circumferential, uniformly narrow edge zone 11 which frames layer 2.

In total, forty-eight pipette tips 3 are disposed on layer 2 in a grid of eight equidistant rows and six equidistant columns. The cone-shaped pipette tips 3 are oriented upward, perpendicularly to the plane of carrier 1, with their conically converging, circular tip opening 12. A likewise expanded push-on sleeve 13 which terminates in a planar annular edge 14 connects to the back, expanded end of each pipette tip 3. This narrow annular edge 14 represents the contact surface for the adhesive attachment of pipette tips 3 on layer 2, or the carrier 1 releasably attached thereto.

It will be understood that the above description of the present invention is susceptible to various modifications, changes and adaptations, and the same are intended to be comprehended within the meaning and range of equivalents of the appended claims.

What is claimed is:

1. A packaging unit for pipette tips that have at their back ends a push-on sleeve having an annular edge, comprising a planar, plate-shaped, rectangular, thin carrier having a top side carrying a layer of a pressure adhesive, the pipette tips being releasably glued by their annular edges to the carrier in equidistant rows and columns, said layer including a thin sheet comprising an upper film and a lower film of the pressure adhesive, and said lower film of the pressure adhesive being formed of a plurality of narrow, spaced strips disposed parallel to one another.

2. A packaging unit as defined in claim 1, wherein the carrier has on its top side a narrow, circumferential edge free from the layer of pressure adhesive.

3. A packaging unit as defined in claim 1, wherein the carrier comprises corrugated paper.

4. A packaging unit as defined in claim 1, wherein the carrier has a thickness of approximately one millimeter.

* * * * *